United States Patent [19]

Mount

[11] 4,090,462

[45] May 23, 1978

[54] DUAL ANCHOR APPARATUS AND METHOD OF USING SAME

[75] Inventor: Wadsworth W. Mount, Warren, N.J.

[73] Assignee: Bossert Manufacturing Corporation, Utica, N.Y.

[21] Appl. No.: 795,437

[22] Filed: May 10, 1977

[51] Int. Cl.[2] ..... B63B 21/24

[52] U.S. Cl. ..... 114/293

[58] Field of Search ..... 114/293, 294, 295, 144 B, 114/230

[56] References Cited

U.S. PATENT DOCUMENTS

| | | | |
|---|---|---|---|
| 3,151,594 | 10/1964 | Collipp | 114/293 |
| 3,386,407 | 6/1968 | Mount | 114/293 |
| 3,620,181 | 11/1971 | Naczkowski | 114/293 |

*Primary Examiner*—Trygve M. Blix
*Assistant Examiner*—Jesus D. Sotelo
*Attorney, Agent, or Firm*—Cooper, Dunham, Clark, Griffin & Moran

[57] ABSTRACT

This dual anchor apparatus includes two anchors which are lowered on a single anchor line. The line extends from the vessel carrying it to a pulley and thence to one of the two anchors. That anchor is also releasably connected to the line at a point spaced above the pulley. During implantation, that anchor rides above the pulley and hence is called the upper anchor. Another line extends from the pulley support to the other anchor, which rides below the pulley and is the lower anchor. The method of implanting the two anchors in the bottom includes conventionally implanting the lower anchor, then paying out more line while the vessel proceeds, thereby lowering the upper anchor to the bottom at a calculated distance from the lower anchor, thereafter disconnecting the releasable connection and then tightening the line through the pulley to drag the upper anchor toward the lower anchor to implant it firmly, so that subsequent tension on the main line pulls the anchors toward each other. A single pair of anchors may be used with a ship or a buoy. For more complex structures, a plurality of dual anchor assemblies, each with its own line, may be implanted in the bottom at peripherally spaced points around the structure to be anchored. Modifications of the anchor assembly may include block and tackle arrangements to increase the mechanical advantage.

14 Claims, 12 Drawing Figures

DUAL ANCHOR APPARATUS AND METHOD OF USING SAME

CROSS-REFERENCE

This invention is an improvement on the anchoring mechanism shown and claimed in my prior U.S. Pat. No. 3,386,407.

BRIEF SUMMARY OF THE INVENTION

The essential feature of the invention is a dual anchor assembly. Each anchor assembly includes two anchors, a pulley, a first line means extending from the lower anchor to the pulley support, second line means extending from a permanent connection with the upper anchor through the pulley to the vessel, and a releasable temporary connection between the upper anchor and a connecting element located on the second line means and spaced from the pulley toward the vessel. The two anchors are implanted and are pulled towards each other by the main anchor line, exerting its force through the pulley, and thereby are firmly embedded in the bottom.

Modifications of the dual anchor assembly may include block and tackle arrangements between one or both anchors and the pulley to increase the mechanical advantage for tightly embedding the anchors.

A dual anchor assembly as described is implanted in the bottom by first implanting the lower anchor in the bottom in conventional fashion. Thereafter the line is drawn by the vessel and paid out until the pulley and the second anchor both rest on the bottom. The temporary connection between the line and the upper anchor is then released. The line is then tensioned to turn the second anchor, if necessary, and implant it in a direction opposite to the direction of implantation of the first anchor. The vessel is then anchored by the anchor assembly including two opposed anchors which are pulled toward each other by the single line from the vessel.

This anchor assembly provides a nearly horizontal pull on each anchor by a vertical or nearly vertical line, without the necessity of using substantial scope (the diagonal distance between the anchor and the vessel, conventionally about five or six times the water depth).

The line may be transferred from the vessel to a buoy or to some more complex structure which is to be moored in place. When such a complex structure, e.g., a drilling rig, is to be anchored, several dual anchor assemblies can be engaged at the bottom at peripherally spaced points around the drilling rig, each assembly comprising a "single point mooring".

DRAWINGS

DETAILED DESCRIPTION

Figure 1:
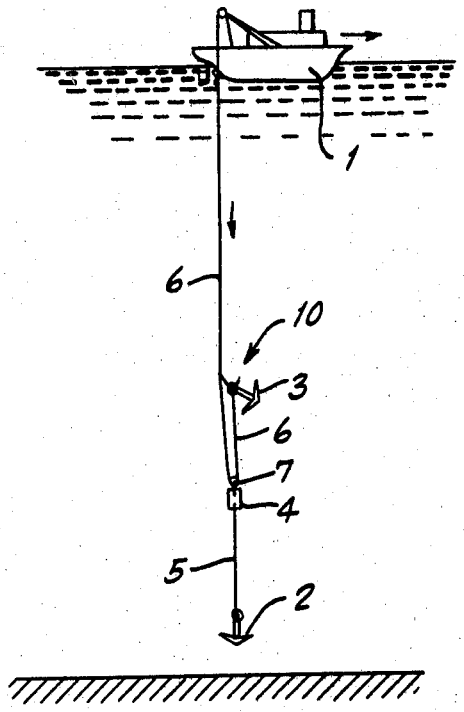
FIG. 1 is a diagrammatic view showing a ship lowering a dual anchor assembly constructed in accordance with the invention.

FIG. 1 shows a ship 1 lowering by a conventional winch an anchor assembly including a lower anchor 2, an upper anchor 3, a pulley block 4, a first line or anchor pennant 5 extending between the anchor 2 and the pulley block 4 and a main line 6 shackled to the upper anchor 3 and extending over a pulley 7 on the pulley block and thence upwardly to the ship 1. A releasable temporary connection 10 is provided between the upper anchor 3 and a point on the line 6 spaced above the pulley block 4. In the positions shown in FIG. 1, the ship is proceeding toward the right and has lowered the anchor assembly so that the lower anchor 2 has not quite reached the bottom.

Figure 2:
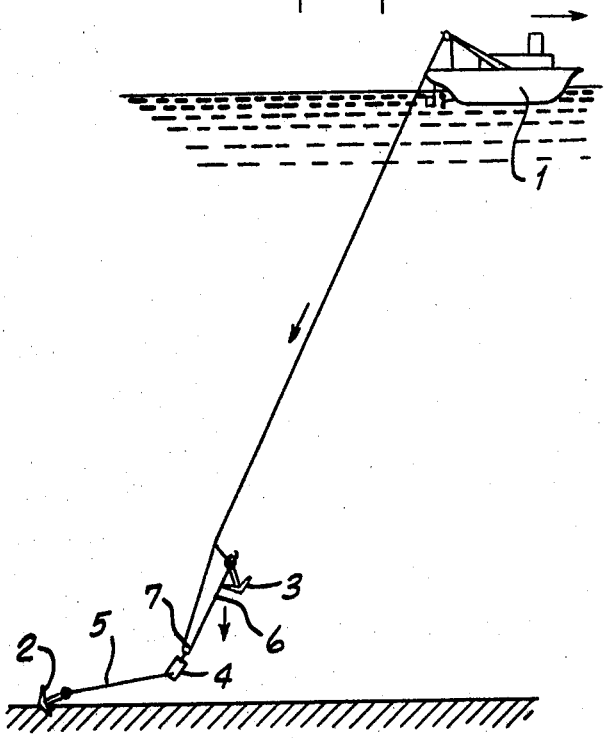
FIG. 2 is a view similar to FIG. 1, showing the lower anchor of the assembly engaged with the bottom.

In FIG. 2 the anchor 2 has engaged the bottom and has been dragged by the ship so as to embed itself partially in the bottom. The crew of the ship having discovered this engagement by means of a tension measuring apparatus on the line 6 is now paying out the line 6 at a faster rate than occasioned by the forward movement of the ship so that the block 4 and the upper anchor 3 are now moving downwardly toward the bottom.

Figure 3:
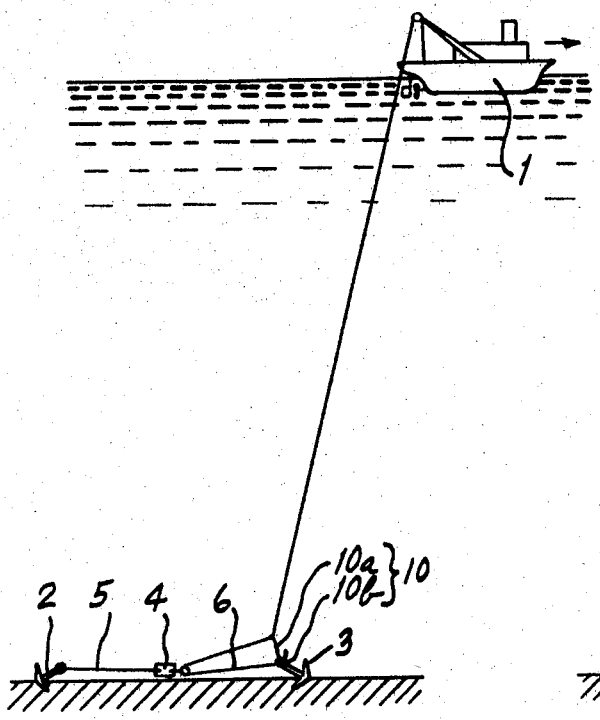
FIG. 3 is a similar view showing the upper anchor of the assembly touching the bottom, while the ship proceeds.
Figure 4:
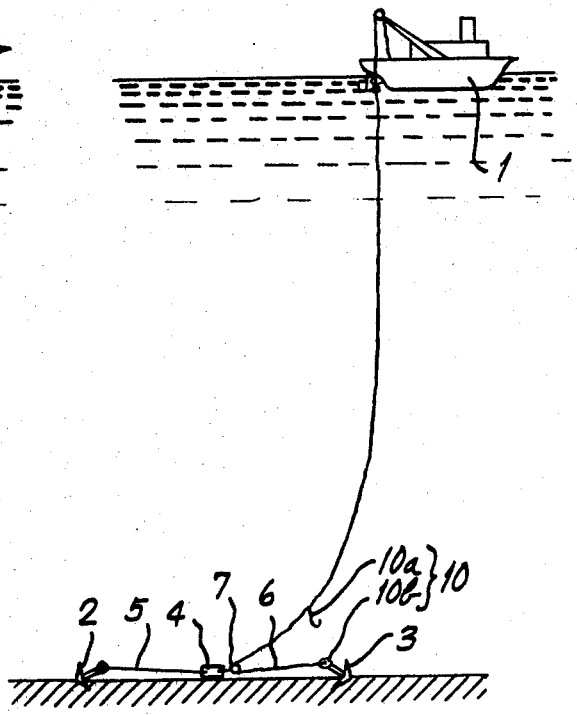
FIG. 4 is a view showing the releasing of the temporary connection between the line and the upper anchor.

In FIG. 3, the block 4 and the anchor 3 have reached the bottom. The removal of the weight of anchor 3 from line 6 is effective to release the connection 10, which may consist of a hook 10*a* fastened to the line 6 and a ring 10*b* on the anchor 3. Other suitable releasable connections may be used. The release may be controlled from the ship or may be automatic. Release of connection 10 is shown in FIG. 4.

The forward motion of the ship then pulls on the anchor line 6, thereby acting through the pulley 7 to embed both anchors 2 and 3 firmly in the bottom.

If the anchor 3 comes to rest on the bottom with its shank pointing toward the anchor 2, then the embedding of anchor 3 starts immediately with the pull on the line 6 after the connection 10 is released. If the anchor 3 comes to rest with its shank pointed in some other direction, then the initial pull on the line 6 after the release of the temporary connection is effective to turn the anchor and orient its shank toward the anchor 2, after which the embedding of anchor 3 starts. It is thus ensured that the two anchors are implanted in oppositely facing directions by a single line having its lower end running over a pulley located between the two anchors.

Figure 5:
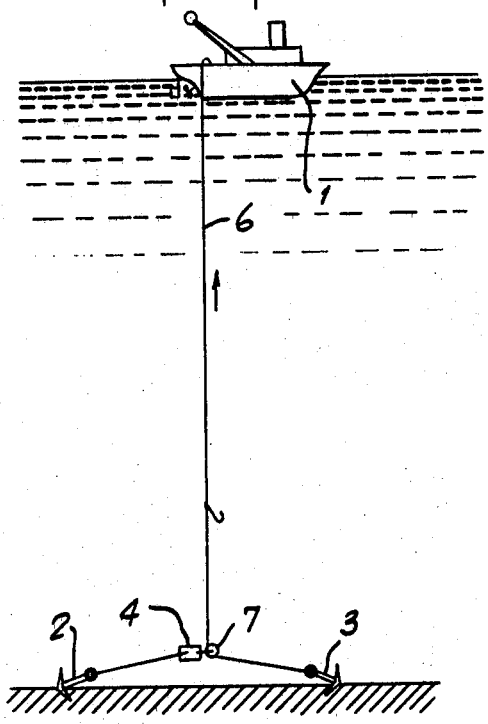
FIG. 5 shows the line tightened to engage both anchors firmly with the bottom and facing in opposite directions.

FIG. 5 shows the moored ship after the line 6 has been tensioned. While the ship is shown vertically over the pulley 7, that line might possibly extend at a substantial angle to the vertical, while the pull on both anchors is almost horizontal.

Figure 6:
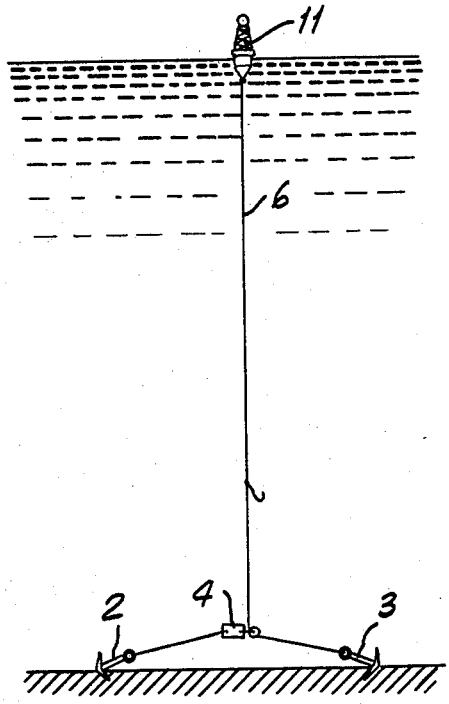
FIG. 6 shows the anchor line transferred from the ship of FIG 5. to a buoy.
Figure 7:
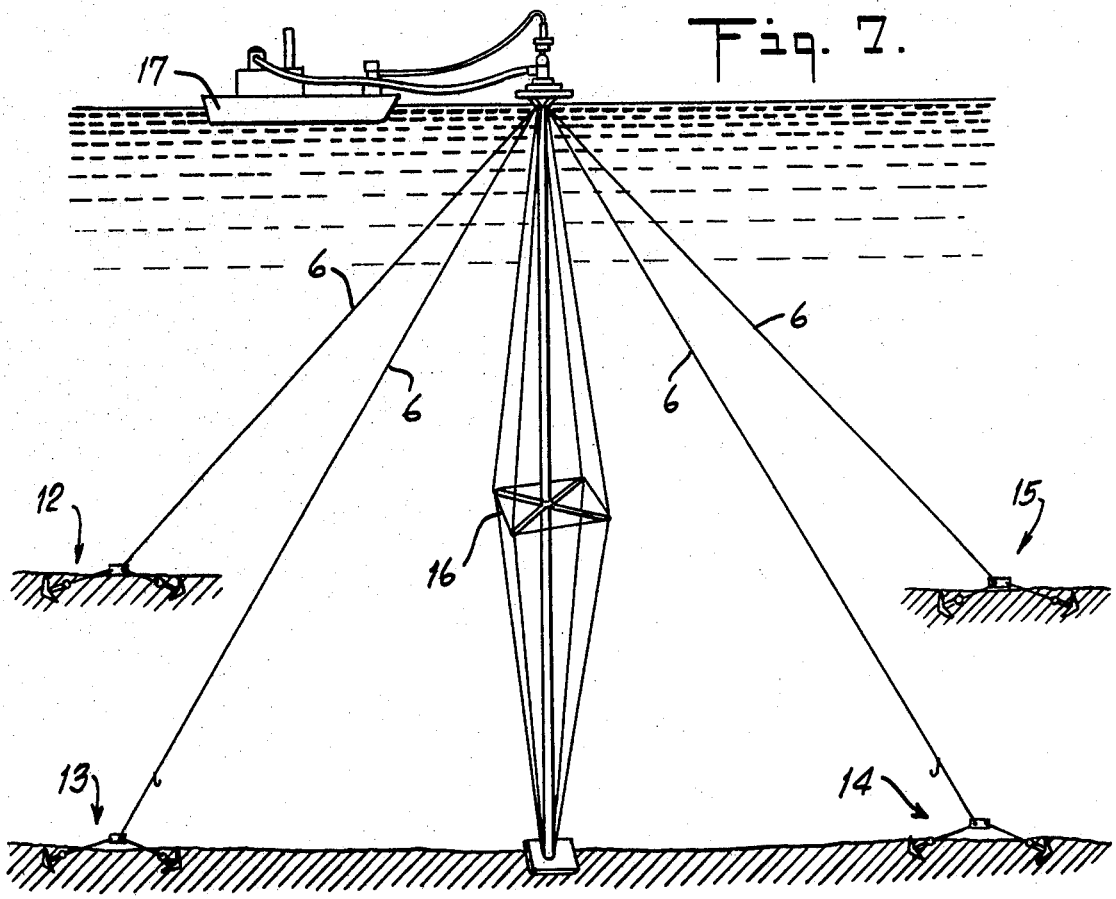
FIG. 7 shows a complex structure, which may be a drilling rig, mounted on the bottom and guyed by four dual anchor assemblies.

In FIG. 6, the upper end of the line 6 has been transferred from the ship 1 to a buoy 11, which is now firmly anchored to the bottom by the line 6 and the anchor assembly. Any slackening of the line 6 is readily taken up by the springing of the lines and movement of the pulley 7, and can be further compensated at the buoy if desired.

FIG. 7

This figure shows four anchor assemblies 12, 13, 14 and 15 connected by their respective lines 6 to the surface end of a structure 16, which rests on the bottom, and is illustrated as serving a tanker 17. Alternatively, the structure so anchored may be floating. The lines 6 are mooring lines which collectively guy the upper end of the structure 16, to hold it effectively against lateral movement or against vertical tension.

FIG. 8

Figure 8:
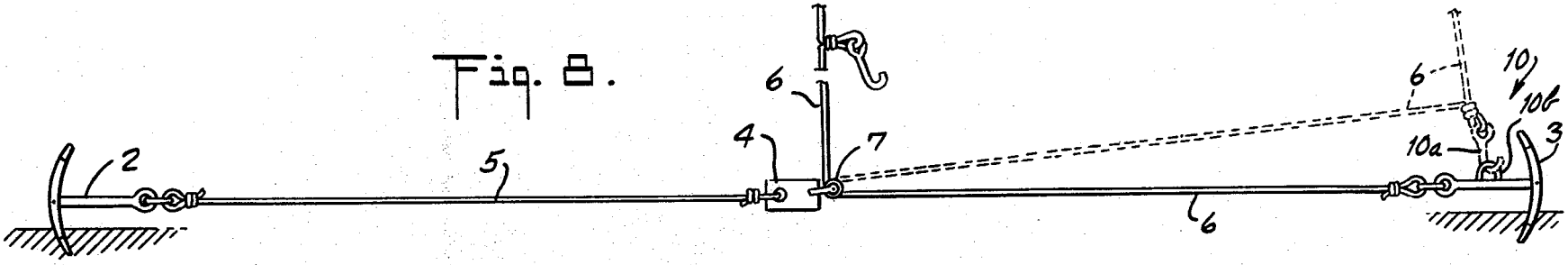
FIG. 8 is an elevational view, showing a dual anchor assembly in accordance with the invention, engaged with the bottom, and showing in dotted lines the positions of the parts when the releasable connection is engaged.

FIG. 8 shows in greater detail the anchor assembly of FIGS. 1 to 6. The anchor 2 is connected by line 5 to the pulley block 4. The anchor 3 is permanently connected to the end of line 6 which extends over the pulley 7 on the block 4 and thence upwardly to the ship. The releasable temporary connection 10 is shown as a hook 10*a* fastened to the line 6 and a ring 10*b* fastened to the shank of the anchor 3.

FIG. 9

The anchor assembly in this figure has been modified from that of FIG. 8 by provision of a pulley 21 on the anchor 3. The main line 22 now extends from the modified pulley block 23 over the pulley 21, thence over the pulley 7 on the block 23 and upwardly to the ship.

FIG. 10

In this modification, the pulley block carries two pulleys 7 and 24. The main line 25 starts from an end made fast to the anchor 3 and extends over pulleys 24, 21 and 7 vertically to the ship.

FIG. 11

In this figure, a pulley 31 has been added to the anchor 2 and a modified pulley block 32 carries two pulleys 33 and 34. The anchor 3 carries only the single pulley 21. The main line 35 extends from the pulley block 32 over the pulley 31 thence over pulleys 34, 21 and 33 to the ship.

FIG. 12

In this modification, the anchor 2 carries two pulleys 31 and 36. A modified pulley block 37 carries four pulleys 41, 42, 43 and 46. The anchor 3 carries two pulleys 21 and 44. The main line 45 extends from the pulley block 37 over the pulleys 31, 42, 44, 41, 36, 46, 21 and 43 to the ship.

Figure 11:
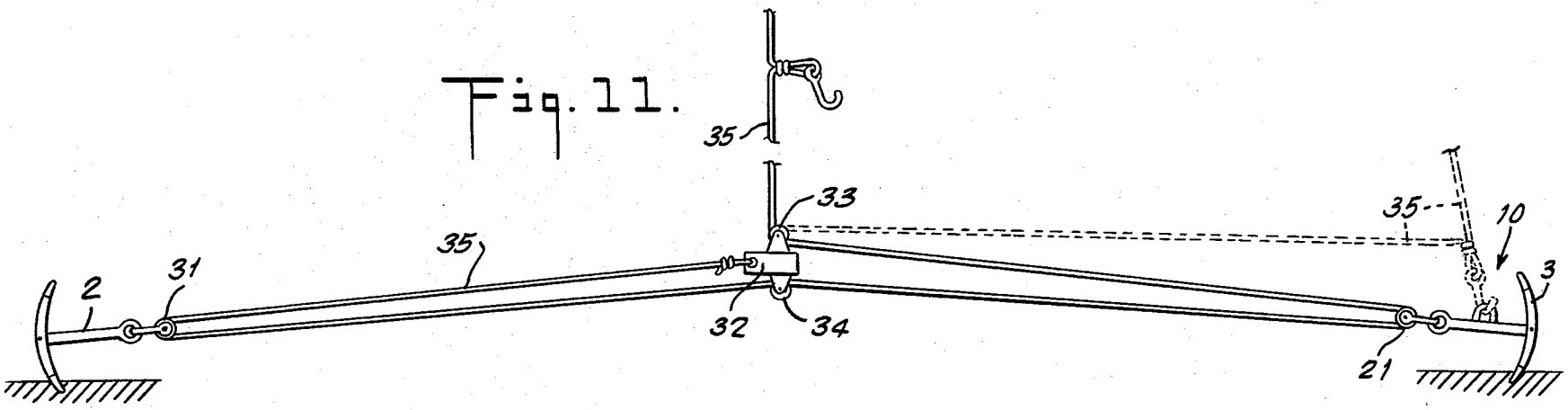

In FIG. 11, there is provided one pair of pulleys on the two anchors, over which pair of pulleys the main line is guided before passing over the last pulley 33 on the pulley block to the ship.

Figure 12:
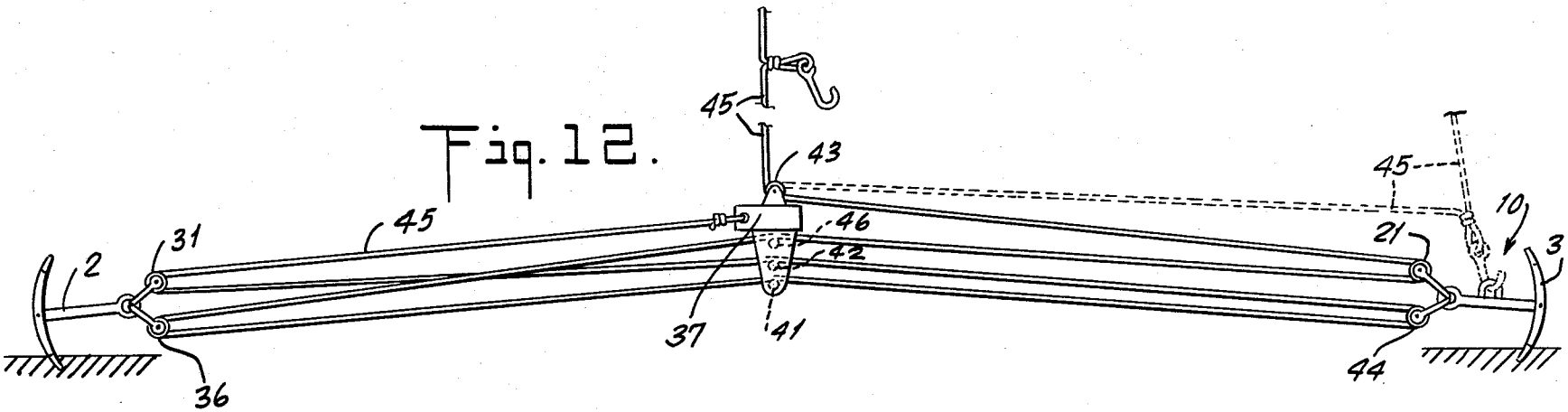

In FIG. 12, there are two pairs of pulleys, namely 31, 21 and 36,44. The main line passes sucessively over those pairs of pulleys before passing over the final pulley 43 and upwardly to the ship.

Figure 10:
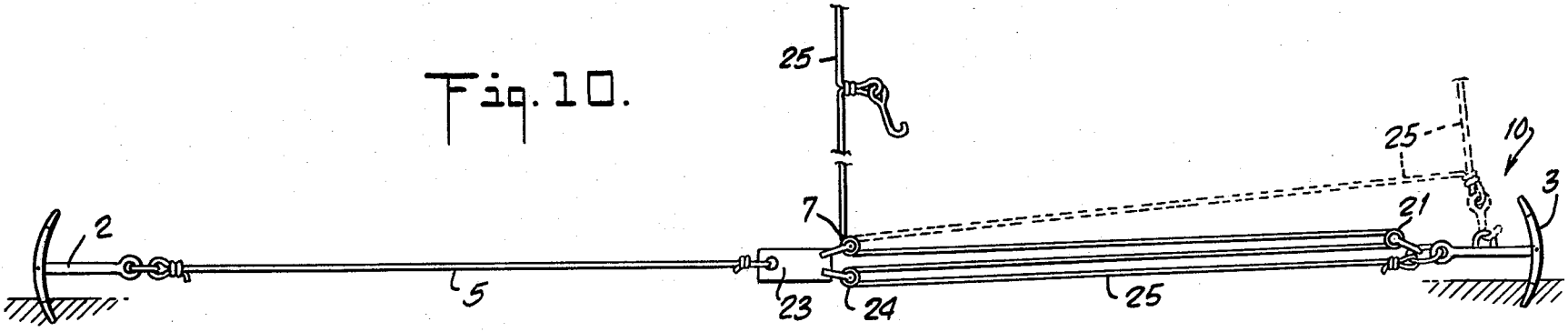

In FIGS. 10–12, wherever two pulleys are mounted on the same support, they are shown on vertically spaced axes so as to clarify the drawing. In a practical structure, they may be aligned on one axis, in accordance with the usual block-and-tackle practice.

A conventional anchor pennant and surface buoy can be fastened to one of the anchors before deployment, to assist in locating and retrieving the anchors, if desired.

By selecting the mechanical advantage of the block and tackle employed, this mooring system allows selection of the ratio between the tension in the main line and the forces applied to the anchors. That tension and those forces may be varied as required for different installations, which may differ widely, e.g., for different depths.

Figure 9:
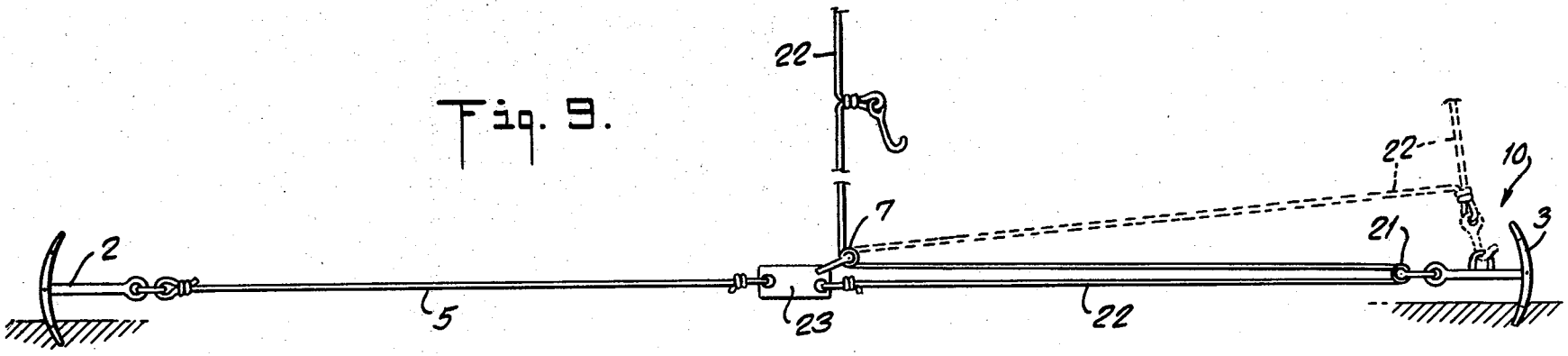
FIGS. 9, 10, 11 and 12 are views similar to FIG. 8, showing modifications.

FIGS. 8, 9 and 10 show the anchors being deployed, while FIGS. 11 and 12 show the anchors after implantation and development of tension in the lines.

The lifting of the pulley block is effective to lift the pulleys and the lines between the anchors off the bottom.

Regardless of the azimuthal orientation of the main line between the pulley block and the surface, the pull on each of the two anchors is always substantially toward the other anchor, i.e., always substantially in the direction of its original implantation and hence always substantially in a direction to increase that implantation and not to drag the anchor free.

While the pulleys 7, 24, 33, 43 and others have been shown and described as being mounted on a pulley block, it should be understood that other suitable equivalent supports, in which one or more pulleys may be journaled, may be employed in substitution for any of the pulley blocks illustrated. The term "pulley block" as used in this specification and claims is a generic term inclusive of such equivalent supports.

I claim:

1. Dual anchor apparatus adapted to be lowered to the bottom from a vessel, including:

a. lower and upper anchors;

b. a pulley block and a pulley thereon;

c. first line means extending from the lower anchor to the block;

d. second line means extending from the upper anchor through the pulley to the vessel; and e. releasable connecting means including a first connecting element on the upper anchor and a second connecting element adapted to cooperate with the first element and located on the second line means and spaced from the block toward the vessel.

2. Dual anchor apparatus as in claim 1, in which said first and second connecting elements are held in engagement during lowering of the anchor apparatus, said elements being releasable from each other after the upper anchor rests on the bottom.

3. Dual anchor apparatus as in claim 2, in which one of said connecting elements is a hook and the other connecting element is a ring.

4. Dual anchor apparatus as in claim 1, in which said first line means is of fixed length, and the second line means is separated from the first line means.

5. Dual anchor apparatus as in claim 4, in which the distance along the second line means from the upper anchor through the pulley to the second connecting element is substantially twice the length of the first line means.

6. Dual anchor apparatus as in claim 4, including:

a. a second pulley on said upper anchor;

b. said second line means extends from the block over the second pulley and back through the first pulley to the vessel; and c. the length of the second line means from the block through the two pulleys to the second connecting element is three times the length of the first line means.

7. Dual anchor apparatus as in claim 4, including:

a. a second pulley on the upper anchor;
b. a third pulley on the block;
c. said second line means extends from the upper anchor over the third pulley, thence over the second pulley, and thence over the first-mentioned pulley to the vessel; and
d. the length of the second line means from the upper anchor to the second connectng element is substantially four times the length of the first line means.

8. Dual anchor apparatus as in claim 1, including
a. at least one pair of pulleys, each pair consisting of one pulley on the lower anchor and one on the upper anchor;
b. said first line means and said second line means being parts of a single line;
c. said single line extending from the block to a pulley of one pair on the lower anchor, thence to the other pulley of that pair on the upper anchor, and thence over the pulley on the block to the vessel.

9. A method of implanting a dual anchor apparatus in the bottom of a body of water, comprising the steps of:
a. lowering from a vessel, while the vessel is under way, a dual anchor assembly including lower and upper anchors, a pulley block, first line means extending from the lower anchor to the block, second line means extending from the upper anchor through a pulley on the block to the vessel, and a releasable connection between the upper anchor and the second line means at a locality thereon spaced from the block toward the vessel;
b. continuing the lowering of the anchor assembly while the vessel is under way until the lower anchor is implanted in the bottom in a direction determined by the direction of motion of the vessel;
c. continuing the motion of the vessel in the same direction while paying out the second line means until the block and upper anchor touch the bottom;
d. releasing said connection; and
e. tightening the second line means to cause implanting of the upper anchor in the bottom in a direction opposite to the direction of implanting of the lower anchor.

10. A method of implanting a dual anchor apparatus in the bottom of a body of water, comprising the steps of:
a. lowering from a vessel a dual anchor assembly including lower and upper anchors, a pulley block, first line means extending from the lower anchor to the block, second line means extending from the upper anchor through a pulley on the block to the vessel, and a releasable connection between the upper anchor and the second line means at a locality thereon spaced from the block toward the vessel;
b. continuing the lowering of the anchor assembly until the lower anchor touches the bottom;
c. moving the vessel with the lower anchor in contact with the bottom to implant the lower anchor in the bottom in a direction determined by the direction of motion of the vessel;
d. continuing the motion of the vessel in the same direction while paying out the second line means until the block and upper anchor touch the bottom;
e. releasing said connection; and
f. tightening the second line means to cause implanting of the upper anchor in the bottom in a direction opposite to the direction of implanting of the lower anchor.

11. A method of mooring a structure in a body of water, comprising the steps of:
a. lowering from a vessel a dual anchor assembly including lower and upper anchors, a pulley block, first line means extending from the lower anchor to the block, second line means extending from the upper anchor through a pulley on the block to the vessel, and a releasable connection between the upper anchor and the second line means at a locality thereon spaced from the block toward the vessel;
b. continuing the lowering of the anchor assembly until the lower anchor touches the bottom;
c. moving the vesel with the lower anchor in contact with the bottom to implant the lower anchor in the bottom in a direction determined by the direction of motion of the vessel;
d. continuing the motion of the vessel in the same direction while paying out the second line means until the block and upper anchor touch the bottom;
e. releasing said connection; p1 f. tightening the second line means to cause implanting of the upper anchor in the bottom in a direction opposite to the direction of implanting of the lower anchor; and
g. fastening the vessel end of the second line means to the structure to be moored.

12. A method of mooring a structure as in claim 11, including repeating the step of claim 11 with a plurality of dual anchor assemblies at a plurality of points spaced horizontally from the structure, so as to provide a plurality of mooring lines anchored at points peripherally spaced around the structure.

13. The method of claim 11, in which the structure extends above the surface of the water and the fastening of the second line means to the structure is adjacent the surface of the water.

14. A method of mooring a structure as in claim 11, including repeating the steps of claim 11, with a plurality of dual anchor assemblies at a plurality of locations on the bottom, so as to provide a plurality of spaced mooring lines fastened to the structure and firmly anchored to the bottom.

* * * * *